US009739442B2

(12) United States Patent
Cho

(10) Patent No.: US 9,739,442 B2
(45) Date of Patent: Aug. 22, 2017

(54) TRANSFORMABLE LIGHTING APPARTUS

(71) Applicant: I2M Co., Ltd., Daejeon (KR)

(72) Inventor: Dong Yeon Cho, Daejeon (KR)

(73) Assignee: I2M Co., Ltd., Daejeon (KR)

( * ) Notice: Subject to any disclaimer, the term of this patent is extended or adjusted under 35 U.S.C. 154(b) by 0 days.

(21) Appl. No.: 15/333,294

(22) Filed: Oct. 25, 2016

(65) Prior Publication Data

US 2017/0138560 A1 May 18, 2017

(30) Foreign Application Priority Data

Nov. 12, 2015 (KR) ..... 10-2015-0158921

(51) Int. Cl.

| | |
|---|---|
| ***F21S 6/00*** | (2006.01) |
| ***F21V 1/08*** | (2006.01) |
| ***F21V 23/02*** | (2006.01) |
| ***F21V 14/08*** | (2006.01) |
| ***F21V 17/10*** | (2006.01) |

(52) U.S. Cl.

CPC ..... *F21V 1/08* (2013.01); *F21S 6/005* (2013.01); *F21V 14/08* (2013.01); *F21V 17/107* (2013.01); *F21V 23/02* (2013.01)

(58) Field of Classification Search

CPC .... F21S 6/005; F21V 1/06; F21V 1/08; F21V 17/07

USPC ..... 362/351–361

See application file for complete search history.

(56) References Cited

U.S. PATENT DOCUMENTS

| | | | | |
|---|---|---|---|---|
| 2,670,431 A * | 2/1954 | Bullock | ..... | F21V 1/00 160/176.1 R |
| 5,613,770 A * | 3/1997 | Chin, Jr. | ..... | F21V 1/06 248/220.1 |
| 2007/0171648 A1* | 7/2007 | Tickner | ..... | F21V 11/02 362/279 |

(Continued)

FOREIGN PATENT DOCUMENTS

| | | |
|---|---|---|
| JP | 3122316 U | 5/2006 |
| KR | 10-1998-0043117 | 8/1998 |

(Continued)

OTHER PUBLICATIONS

English translation of 10-1270894.

(Continued)

*Primary Examiner* — Sean Gramling
*Assistant Examiner* — Gerald J Sufleta, II
(74) *Attorney, Agent, or Firm* — Antonio Ha & U.S. Patent, LLC

(57) ABSTRACT

According to an embodiment of the present disclosure, a transformable lighting apparatus, comprises support frames respectively coupled with two sides of a socket, a ring coupler coupled with respective ends of the support frames, operational frames respectively coupled with the respective ends of the support frames, pivoted by a motor, and respectively including trenches coupled with a motor support, the motor support encompassing the motor and including a hole into which the ring coupler is fitted and connection terminals around the hole, and a cover coupled with the operational frames and formed of an accordion-shape, non-woven fabric to be transformable by rotation of the operational frames.

1 Claim, 7 Drawing Sheets

(56) References Cited

U.S. PATENT DOCUMENTS

| | | | | |
|---|---|---|---|---|
| 2010/0142209 | A1* | 6/2010 | Cuppett | F21L 14/04<br>362/311.08 |
| 2012/0300436 | A1* | 11/2012 | Hackett | F21S 9/037<br>362/127 |
| 2015/0292706 | A1* | 10/2015 | Feher Canadell | F21V 1/06<br>362/434 |

FOREIGN PATENT DOCUMENTS

| | | |
|---|---|---|
| KR | 10-0375322 | 3/2003 |
| KR | 10-0973693 | 8/2010 |
| KR | 10-1270894 | 6/2013 |
| KR | 10-1538512 | 7/2015 |

OTHER PUBLICATIONS

English translation of 10-1538512.
English translation of 10-1998-0043117.
English translation of 3122316.
English translation of 10-0973693.
English translation of 10-0375322.

* cited by examiner

TRANSFORMABLE LIGHTING APPARTUS

CROSS-REFERENCE TO RELATED APPLICATIONS

This patent application claims priority under 35 U.S.C. §119 to Korean Patent Application No. 10-2015-0158921, filed on Nov. 12, 2015, in the Korean Intellectual Property Office, the disclosure of which is incorporated by reference herein in its entirety.

TECHNICAL FIELD

Embodiments of the present disclosure concern lamps, lights, or other lighting apparatuses and lamp shades, and more specifically, to a lighting apparatus transformable in shape or appearance.

DISCUSSION OF RELATED ART

A lampshade is a fixture that covers the lightbulb on a lamp to diffuse the light it emits. Conical, cylindrical and other forms on floor-, desk- or table top-mounted as well as suspended lamp models are the most common and are made in a wide range of materials. The lampshade can also apply to the glass hung under many designs of ceiling lamp. Beyond its practical purpose, significant emphasis is also usually given to decorative and aesthetic features.

Various lampshades came into the market. Conventional lampshades, however, typically have an unchanged shape and fail to live up to the needs of various users who desire aesthetic changes in shape. Further, such types of lampshades cannot adjust the amount of light emitted from the lamps.

There are a few types of lampshades transformable or light-adjustable. However, such lampshades are mostly tricky to handle or require a complicated mechanism to make desired design changes.

Therefore, there is a need for a type of lampshade that may satisfy the user's desire for decorative and practical effects and a lighting apparatus including such lampshade.

SUMMARY

According to an embodiment of the present disclosure, a transformable lighting apparatus, comprises support frames respectively coupled with two sides of a socket, a ring, coupler coupled, with respective ends of the support frames, operational frames respectively coupled with the respective ends of the support frames, pivoted by a motor, and respectively including trenches coupled with a motor support, the motor support encompassing the motor and including a hole into which the ring coupler is fitted and connection terminals around the hole, and a cover coupled with the operational frames and formed of an accordion-shape, non-woven fabric to be transformable by rotation of the operational frames.

The ends of the support frames are substantially circular in shape, each include a toothed circumferential edge and a central hole through which the ring coupler is coupled with the support frames One of the support frames includes a circuit board connecting with a power source, The circuit board includes a power supplying unit including a positive (+) electrode and a negative (−) electrode substantially circular in shape, spaced apart from each other at a predetermined distance, and providing electric power through the power supplying unit to the motor, the predetermined distance between the positive electrode and the negative electrode substantially the same as a distance between the connection terminals of the motor support.

The motor connects with a worm gear engaging with the toothed edge.

According to an embodiment of the present disclosure, a transformable lighting apparatus comprises the socket coupled with a bulb unit comprising a bulb and a housing including a port for transmitting a signal or electric power.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION OF EXEMPLARY EMBODIMENTS

Hereinafter, exemplary embodiments of the inventive concept will be described in detail with reference to the accompanying drawings. The inventive concept, however, may be modified in various different ways, and should not be construed as limited to the embodiments set forth herein. As used herein, the singular forms "a," "an," and "the" are intended to include the plural forms as well, unless the context clearly indicates otherwise. It will be understood that when an element or layer is referred to as being "on," "connected to," "coupled to," or "adjacent to" another element or layer, it can be directly on, connected, coupled, or adjacent to the other element or layer, or intervening elements or layers may be present.

Figure 1A:
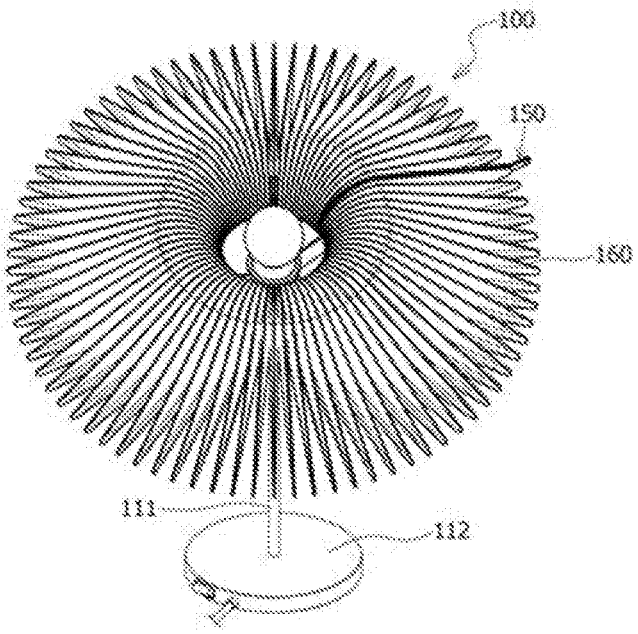
FIG. 1A is a perspective view illustrating a transformable lighting apparatus in an unfolded position according to an embodiment of the present disclosure.
Figure 1B:
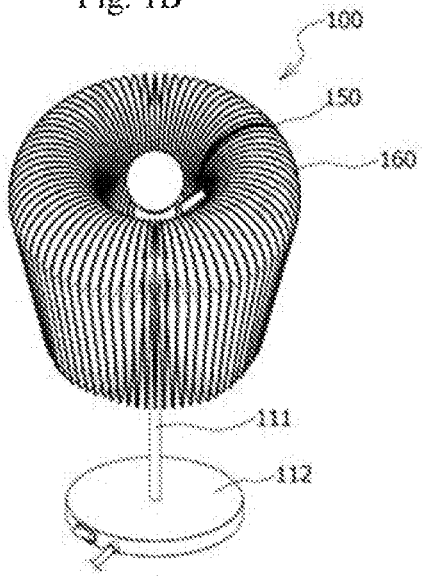
FIG. 1B is a perspective view illustrating a transformable lighting apparatus in a folded position according to an embodiment of the present disclosure.
Figure 2A:
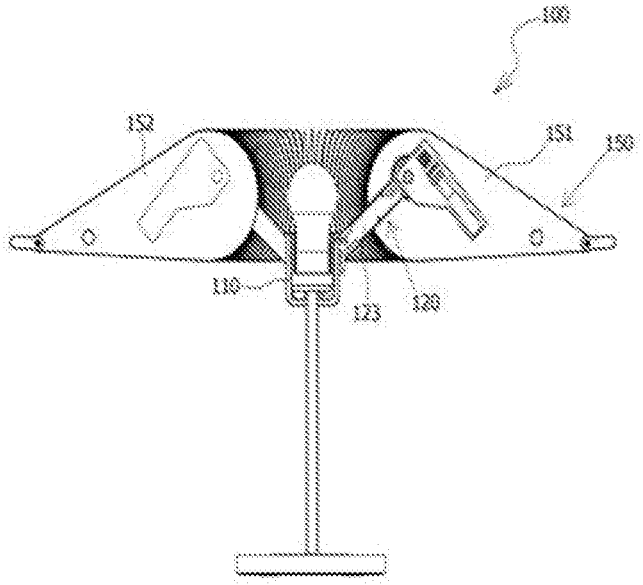
FIG. 2A is a cross-sectional view illustrating a transformable lighting apparatus in an unfolded position according to an embodiment of the present disclosure.
Figure 2B:
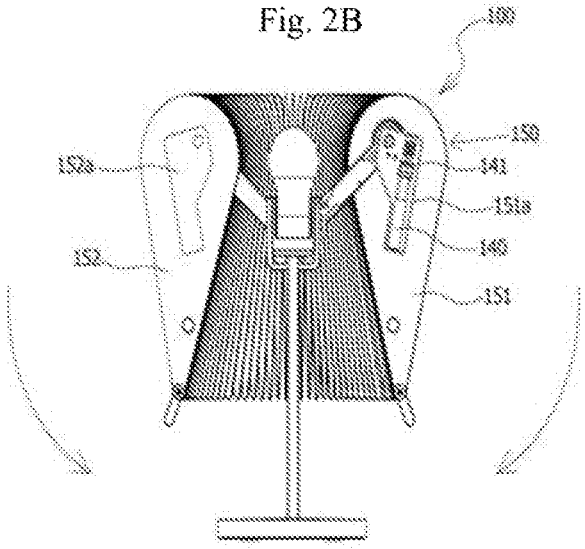
FIG. 2B is a cross-sectional view illustrating a transformable lighting apparatus in a folded position according to an embodiment of the present disclosure.
Figure 3:
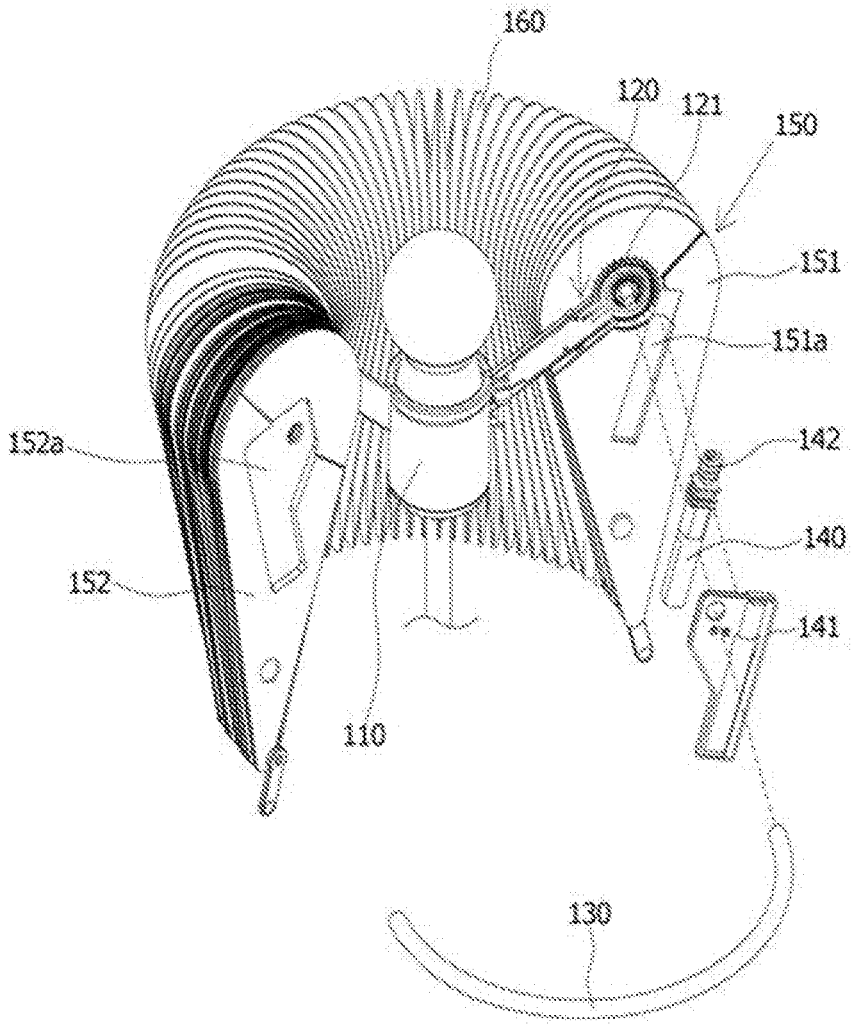
FIG. 3 is an exploded perspective view illustrating a transformable lighting apparatus according to an embodiment of the present disclosure.
Figure 4:
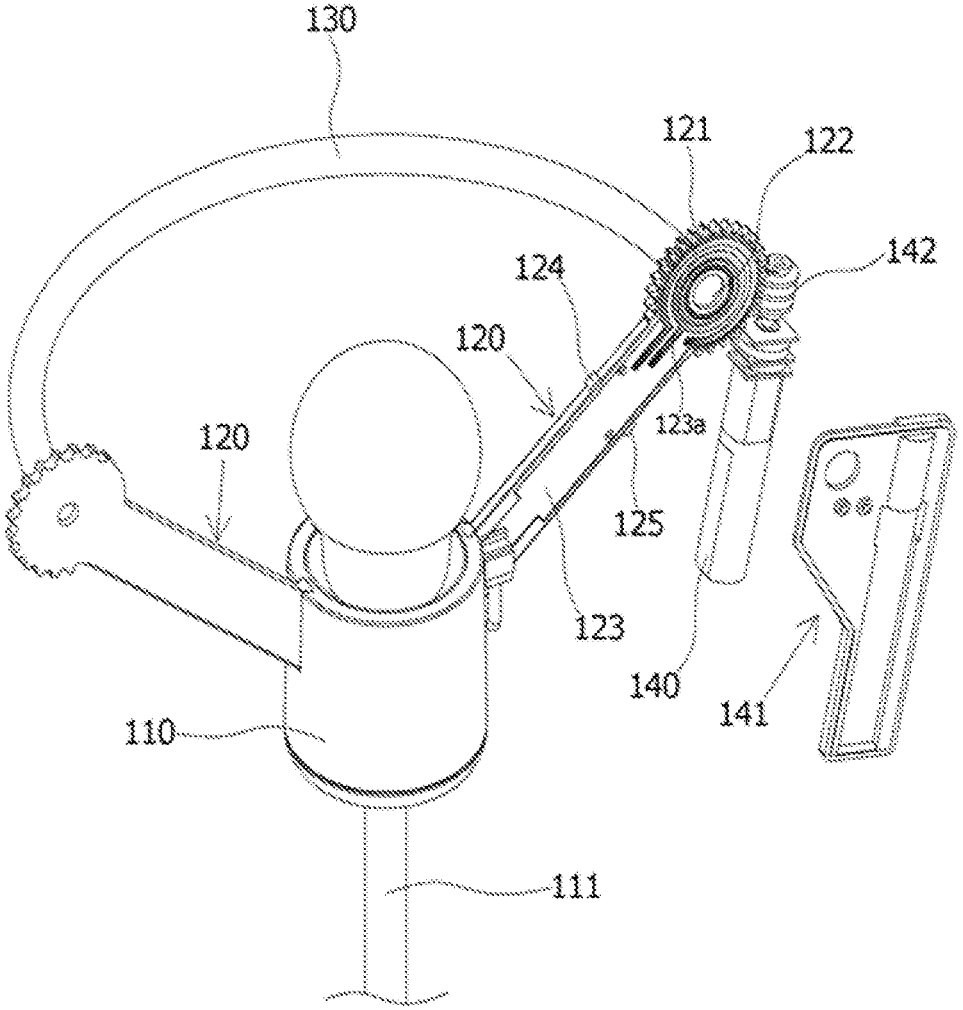
FIG. 4 is an exploded perspective view illustrating a transformable lighting apparatus according to an embodiment of the present disclosure.
Figure 5:
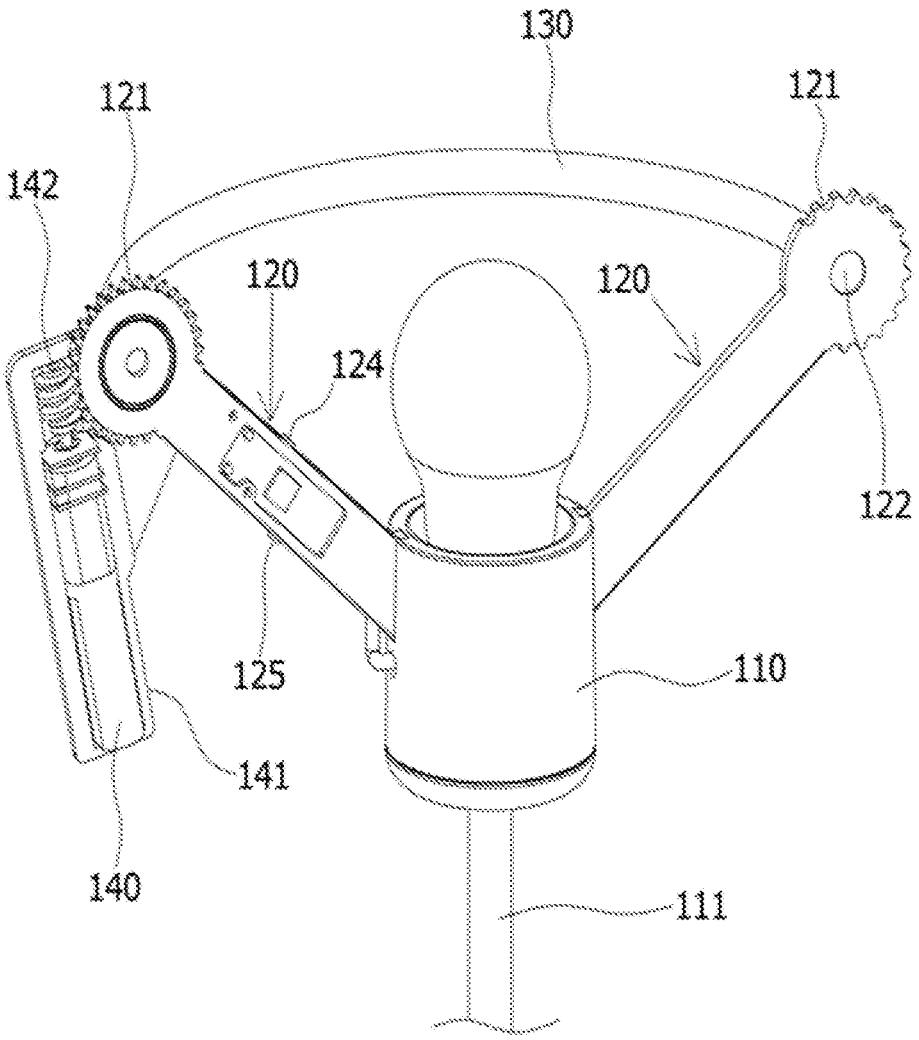
FIG. 5 is an exploded perspective view illustrating a transformable lighting apparatus according to an embodiment of the present disclosure.
Figure 6:
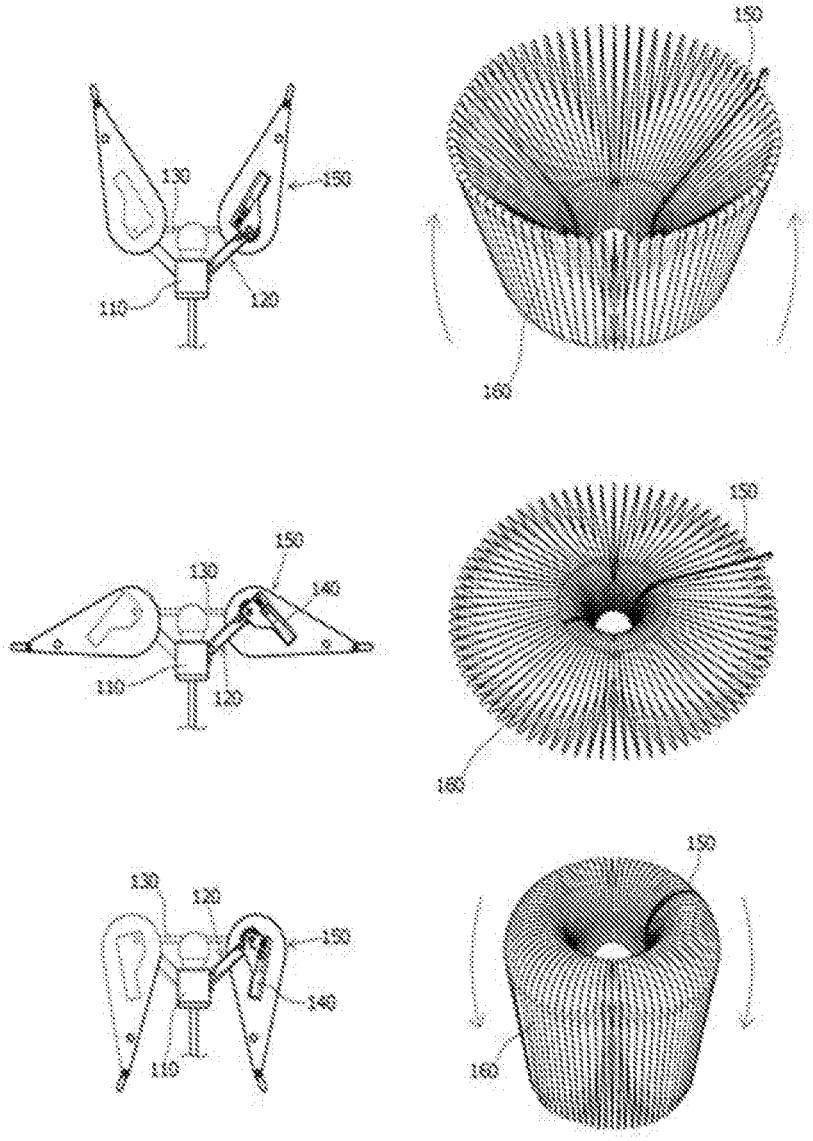
FIG. 6 illustrates examples in which a transformable lighting apparatus works according to embodiments of the present disclosure.
Figure 7:
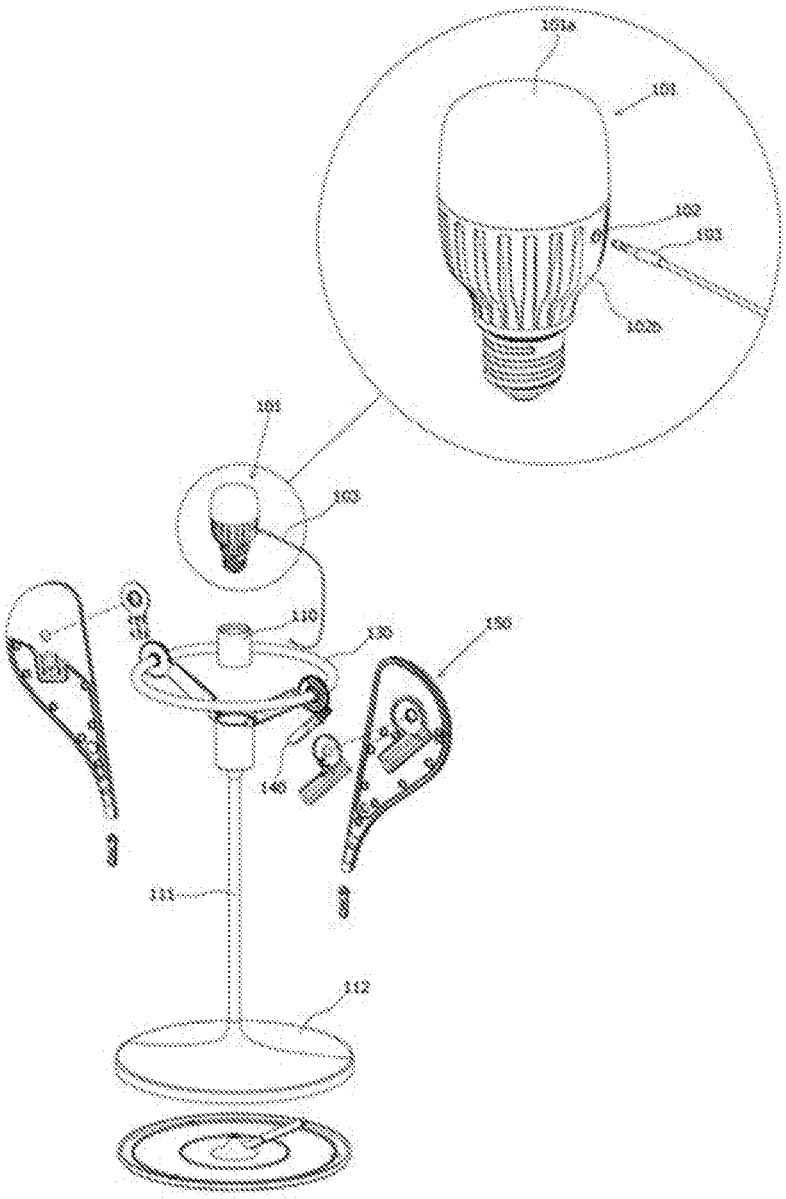
FIG. 7 is an exploded perspective view illustrating a bulb unit with a connection port for transmitting signals or power in a transformable lighting apparatus according to an embodiment of the present disclosure.

FIG. 1A is a perspective view illustrating a transformable lighting apparatus in an unfolded position according to an embodiment of the present disclosure. FIG. 1B is a perspective view illustrating a transformable lighting apparatus in a folded position according to an embodiment of the present disclosure. FIG. 2A is a cross-sectional view illustrating a transformable lighting apparatus in an unfolded position according to an embodiment of the present disclosure. FIG. 2B is a cross-sectional view illustrating a transformable lighting apparatus in a folded position according to an embodiment of the present disclosure. FIG. 3 is an exploded perspective view illustrating a transformable lighting apparatus according to an embodiment of the present disclosure. FIG. 4 is an exploded perspective view illustrating a transformable lighting apparatus according to an embodiment of the present disclosure. FIG. 5 is an exploded perspective view illustrating a transformable lighting apparatus according to an embodiment of the present disclosure. FIG. 6 illustrates examples in which a transformable lighting apparatus works according to embodiments of the present disclosure. FIG. 7 is an exploded perspective view illustrating a bulb unit with a jack for transmitting signals or power in a transformable lighting apparatus according to an embodiment of the present disclosure.

Referring to FIGS. 1 to 7, a lighting apparatus 100 may include support frames 120 respectively coupled with two opposite sides of a socket 110 where a bulb can be coupled or decoupled, a ring coupler 130 coupled with the respective ends of the support frames 120, operational frames 150 respectively coupled with the respective ends of the support frames 120 and pivoted by operation of a motor 140, and a cover 160 connected with the operational frames 150 and formed of an accordion-shape non-woven fabric so that shape of the lighting apparatus is easily transformable by pivoting the operational frames 150.

The support frames 120 may be coupled with two opposite sides of the socket 110. The support frames 120 each may be configured with an upward slope so that a first end of the support frame 120 is higher than a second end thereof. For example, the support frames 120 may be coupled to the socket 110 to be inclined upwards as away from the socket 140.

The first end of each support frame 120 may be substantially circular in shape. The first end may include a toothed edge 121 along its outer circumference surface and a hole 122 in the center thereof allowing for insertion of the ring coupler 130 therethrough. For example, the respective first ends of the support frames 120 may be shaped substantially as discs with toothed outer circumferential edges.

A circuit board 123 in connection with a power source (not shown) may be provided in one of the support frames 120. An end of the circuit board 123 may include a circular power supplying unit 123*a*. The power supplying unit 123*a* may provide electric power with the motor 140 through connection terminals, e.g., pogo pins or other various types of conducting pins for power transmission.

The power supplying unit 123*a* may be configured as or include two circular electrodes, e.g., a positive (+) electrode and a negative (−) electrode, spaced apart from each other at a predetermined distance. Referring to FIGS. 3 and 4, the connection terminals contacting the power supplying unit 123*a* to receive electric power from the power supplying unit 123*a* may be spaced apart from each other at substantially the same distance as the distance between the two circular electrodes of the power supplying unit 123*a*.

Thus, the motor 130 may be powered by, e.g., an external power source, through the power supplying unit 123*a*.

The operational frames 140 may include a first operational frame 151 and a second operational frame 152. Trenches 151*a* and 152*a*, respectively, may be formed in the respective first surfaces of the first operational frame 151 and the second operational frame 152. The motor 140 may be placed in the trench 151*a*.

The cover 160 may be coupled with the respective second surfaces of the first operational frame 151 and the second operational frame 152. The second surfaces of the first and second operation frames 151 and 152 may be opposite surfaces of the first surfaces of the first and second operational frames 151 and 152.

The ring coupler 130 coupled with the respective first ends of the support frames 120 may pass through the cover 160 to support the cover 160.

For example, the ring coupler 130 may penetrate the support frames 120, the operational frames 150, and the cover 160 to couple them together.

A motor support 141 may be installed on the trench 151*a* formed in the first operational frame 151 to fit over and support the motor 140. For example, the motor support 141 may cover the trench 151*a* with the motor 140 placed therein.

A worm gear 142 may be connected with a shaft of the motor 140 engaging with the toothed edge 121.

When a driving force from the motor 140 is delivered to the worm gear 142 through the shaft of the motor, the worm gear 142 may rotate, engaged with the toothed edge 121.

Thus, the motor 140 connected with the worm gear 142 and the motor support 141 may also revolve, pivoting the operational frames 150 on the ring coupler 130.

As the operational frames 150 pivot, the cover 160 connected to the operational frames 150 may pivot accordingly.

When the operational frames 150 pivot on the ring coupler 130, the cover 160 connected to the operational frames 150 may be unfolded or folded, enlarging or shrinking the lighting apparatus 100. As such, the lighting apparatus may produce different appearances.

Such a shape change in the lighting apparatus 100 allows for various decorative effects.

The motor 140 may be configured to run forwards or backwards. For example, the motor 140 may be capable of normal-opposite rotation.

The cover 160 may fold or unfold, changing the angle of an illumination from the bulb screwed in the socket 110 and allowing for adjustment of the intensity of illumination.

The cover 160 may include, but is not limited to, an elastic, non-woven fabric.

According to an embodiment of the present invention, there may be provided two or more operational frames 150 along the ring coupler 130 to more stably support the cover 160.

One end of each operation frame 150 may include a handle.

The handle may have a foldable or pivotal configuration, e.g., for convenience of use.

Attaching members (not shown), respectively, may be provided on the respective surfaces of the first operational frame 151 and the second operation 152 to connect the operational frames 150 with the cover 160. The attaching members may include couplers, an adhesive, clamps, or Velcro™ tapes, or any other various means for connecting or attaching the operational frames 150 with the cover 160.

The first operational frame 151 may be coupled with the second operational frame 152 by way of prominence-and-depression patterns or magnets respectively formed on the two opposite surfaces of the first and second operational frame 151 and 152. However, embodiments of the present disclosure are not limited thereto, and various other types of couplers may be put to use to couple together the first and second operational frame 151 and 152.

An upper limit switch 124 and a lower limit switch 125 respectively may be provided on two opposite edges of one of the support frames 120 to detect and limit rotation of the operational frames 150.

When the support frames 120 are pivoted at a predetermined degree or more by the motor 140 in a first direction, the upper limit switch 124 may operate to deactivate and stop the motor 140, and when the support frames 120 pivot in an opposite direction of the first direction, the lower limit switch 125 may operate to deactivate and stop the motor 140, increasing durability of the motor 140 and the support frame 120.

A supporting pole 111 and supporting plate 112 may be provided to support the socket 110, placing the lighting apparatus 100 on the floor in a vertical position as illustrated in FIG. 7. However, embodiments of the present invention are not limited thereto. For example, the socket 110 or the lighting apparatus 100 may be configured to be hung from the ceiling by wires.

As illustrated in FIG. 7, a bulb unit 101 including a bulb 101*a* and a housing 101*b* may be coupled with the socket 110. The housing 101*a* of the bulb unit 101 may include a connection port 102 for transmitting signals or receiving electric power. The connection port 102 may be a jack socket.

A connector 103 may be plugged in the connection port 102 for externally transmitting signals. The connector 103 plugged in the jack 102 may be connected to the motor 140 or the circuit board 123, supplying power to the motor 140 or the circuit board 123 or enabling communication between the motor 140 or the circuit board 123 and an external source (not shown) to control or adjust the revolutions per minute (RPM) of the motor 140.

The housing 101*b* may include a universal serial bus (USB) port (not shown) or a port (not shown) for charging a cellular phone. The housing 101*b* may have other various types of ports for external connection for multiple purposes.

Described below are examples of operating the transformable lighting apparatus 100 according to an embodiment of the present disclosure.

Electric power may be supplied to the circuit board 123 in the support frame 120 to run the motor 140 through the power supply 123*a*.

The worm gear 142 may rotate along the toothed edge 121 of the support frame 120.

The operational frame 150 with the motor 140 placed therein may pivot, turning the cover 160 coupled therewith.

As the motor 140 rotates forwards or backwards, the operational frames 150 turn accordingly. Thus, the cover 160 coupled with the operational frames 150 folds or unfolds, 0 changing its appearance or shape.

The change in shape of the cover 160 may depend on how many turns the motor 140 makes. Thus, a user may adjust the pivotal angle of the operational frames 150 to modify the cover 160 to his preference.

Such transformation of the cover 160 may not only produce various decorative or aesthetic effects but also allow for adjustment of indoor lighting brightness.

According to an embodiment of the present disclosure, the lighting apparatus may be applicable to various types of lighting, such as chandeliers or stand or desk lamps.

The motor 140 and components for operating the motor 140 (e.g., the circuit board, limit switches, and the worm gear), although shown and described as provided in one of the operational frames 150, may also be provided in each of the operational frames 150 without limited thereto.

While the inventive concept has been shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. A lighting apparatus having a transformable lamp cover for an interior design, comprising:

support frames respectively firmly coupled with two sides of a socket where a lamp is plugged in or out;

a ring coupler inserted and coupled with respective ends of the support frames;

operational frames respectively inserted and coupled with the respective ends of the support frames, pivoted by a motor, and respectively including trenches coupled with a motor support, the motor support having a first side where the motor is inserted and a second side including a hole into which the ring coupler is fitted or inserted pogo pins formed around the hole; and a cover coupled with the operational frames and formed of an accordion-shape, non-woven fabric to be transformable by rotation of the operational frames, wherein the ends of the support frames are substantially circular in shape, each include a toothed circumferential edge and a central hole through which the ring coupler is coupled with the support frames, wherein one of the support frames includes a circuit board connecting with a power source, wherein an end of the circuit board includes a power supplying unit including a positive (+) electrode and a negative (−) electrode substantially circular in shape, spaced apart from each other at a predetermined distance, and providing electric power through the power supplying unit to the motor, the predetermined distance between the positive electrode and the negative electrode substantially the same as a distance between the pogo pins of the motor support, and wherein the motor connects with a worm gear engaging with the toothed edge.

* * * * *